US005566610A

United States Patent [19]

Robinson et al.

[11] Patent Number: 5,566,610

[45] Date of Patent: Oct. 22, 1996

[54] APPARATUS FOR BALING LOOSE MATERIALS

[75] Inventors: Lonnie R. Robinson; Robert L. Taylor, II, both of Mecklenburg County, N.C.

[73] Assignee: Lindemann Recycling Equipment, Inc., Charlotte, N.C.

[21] Appl. No.: 416,959

[22] Filed: Apr. 5, 1995

[51] Int. Cl.[6] ..... B30B 9/30

[52] U.S. Cl. ..... 100/98 R; 100/218; 100/232; 100/252

[58] Field of Search ..... 100/98 R, 215, 100/218, 232, 245, 252

[56] References Cited

U.S. PATENT DOCUMENTS

| | | | |
|---|---|---|---|
| 2,489,198 | 11/1949 | Russell | 100/98 R |
| 2,720,160 | 10/1955 | Tice et al. | 100/98 R |
| 2,811,100 | 10/1957 | Lindemann | 100/98 R |
| 2,923,230 | 2/1960 | Bornzin | 100/98 R |
| 3,003,411 | 10/1961 | Judd | 100/98 R |
| 3,059,569 | 10/1962 | Nolt | 100/98 R |
| 3,126,816 | 3/1964 | Thompson | 100/98 R |
| 3,126,817 | 3/1964 | Thompson | 100/98 R |
| 3,129,656 | 4/1964 | Judd | 100/98 R |
| 3,249,040 | 5/1966 | Van Der Lely | 100/98 R |
| 3,552,307 | 1/1971 | Venable | 100/98 R |
| 3,610,139 | 10/1971 | Bowles | 100/98 R |
| 3,613,556 | 10/1971 | Wright et al. | 100/14 |
| 3,827,349 | 8/1974 | Gilman | 100/98 R |
| 3,906,852 | 9/1975 | Robinson, Jr. et al. | 100/98 R |
| 3,965,812 | 6/1976 | Oberg | 100/98 R |
| 4,102,262 | 7/1978 | Liberman et al. | 100/53 |
| 4,149,457 | 4/1979 | Smith | 100/245 |
| 4,213,385 | 7/1980 | Dahlem | 100/95 |
| 4,230,037 | 10/1980 | Schmalz | 100/95 |
| 4,382,406 | 5/1983 | Vezzani | 100/98 R |
| 4,417,510 | 11/1983 | Sharp | 100/98 R |
| 4,552,062 | 11/1985 | Vezzani | 100/95 |
| 4,658,719 | 4/1987 | Jackson et al. | 100/218 |
| 5,007,337 | 4/1991 | Newsom | 100/188 R |
| 5,069,044 | 12/1991 | Holum et al. | 62/320 |
| 5,081,922 | 1/1992 | Rudd, Jr. et al. | 100/50 |
| 5,242,121 | 9/1993 | Neier | 241/28 |
| 5,247,881 | 9/1993 | Rosser et al. | 100/48 |
| 5,347,921 | 9/1994 | Gourdol | 100/98 R |
| 5,351,613 | 10/1994 | Newsom | 100/98 R |
| 5,363,757 | 11/1994 | Newsom | 100/39 |

FOREIGN PATENT DOCUMENTS

| | | | |
|---|---|---|---|
| 123066 | 5/1931 | Austria | 100/98 R |
| 734595 | 4/1943 | Germany | 100/98 R |
| 1779153 | 3/1974 | Germany . | |
| 53-26477 | 3/1978 | Japan | 100/98 R |

OTHER PUBLICATIONS

C+M Recycling+Solid Waste Management Systems, Application Notes, P–AN90–1, no date.

Ross Corporation, *Thunderbird Unitizer,* pamphlet, 1991.

Ross Corporation, *Thunderbird Two –Ram Balers,* pamphlet, no date.

*Primary Examiner*—Stephen F. Gerrity

*Attorney, Agent, or Firm*—Bell, Seltzer, Park & Gibson, P.A.

[57] ABSTRACT

An apparatus for baling loose materials includes a housing defining a charging passage and a compaction chamber. The baling apparatus also includes a compacting ram platen which moves through the charging passage to compact loose materials into a bale in the compaction chamber. In one embodiment, the baling apparatus includes a reinforcing frame disposed generally circumferentially about at least portion of the housing to provide structural reinforcement. The reinforcing frame defines an aperture through which the floor panel and the first and second opposed side panels of the housing are typically extended during the fabrication of the baling apparatus so as to be supported in a predetermined positional relationship. In another embodiment, the baling apparatus includes a knife assembly including a frame member, such as the reinforcing frame, mounted to the housing and a second cutting edge mounted to the frame member for controlled movement relative thereto. A first cutting edge can be mounted to upper edge portions of the compacting ram platen to cooperate with the second cutting edge to sever loose materials which extend beyond the charging passage. The knife assembly can also include a lateral guide for controlling the lateral position of the second cutting edge, thereby aligning the first and second cutting edges.

22 Claims, 4 Drawing Sheets

APPARATUS FOR BALING LOOSE MATERIALS

FIELD OF THE INVENTION

The present invention relates generally to methods and apparatus for baling loose materials and, more particularly, to a waste material baling apparatus and a related method of fabrication.

BACKGROUND OF THE INVENTION

A number of baling machines have been developed which compact loose materials, such as waste materials, into a relatively dense, compact bale. The compacted bales of waste material can then be more readily transported to a storage or disposal site at which they will occupy less space.

In particular, as the amount of available landfill space continues to diminish, the compaction of waste materials into dense, compact bales prior to their shipment and storage in a landfill becomes increasingly important in order to further reduce the space which the waste materials occupy within the landfill. In addition, with the increasing emphasis placed on environmental concerns and with the recent improvements in recycling technology which allow an even greater percentage of waste materials, such as paper, plastic and cans, to be recycled and reused, the baling of waste materials has become even more important since recyclable waste materials are generally compacted into a bale prior to their shipment to an appropriate recycling facility.

Conventional baling machines generally include a bin or hopper into which loose materials, such as waste material, are deposited. The deposited materials are generally collected in a charging passage defined within the baling machine. The charging passage is typically a longitudinally extending passage which has a parallelepiped shape, such as a rectangular solid shape.

Conventional baling machines also generally include a compacting ram assembly disposed within the charging passage and adapted for longitudinal movement therein. In particular, the compacting ram assembly generally includes a compacting ram platen which is adapted for reciprocating longitudinal movement through the charging passage between a retracted position and an extended position. In the retracted position, loose materials which are deposited in the hopper are collected in the charging passage. As the compacting ram platen is moved longitudinally forward from the retracted position to the extended position, the loose materials are urged through the charging passage and into a compaction chamber. The compaction chamber is also defined within the baling machine and is in communication with an exit end of the charging passage. Accordingly, the loose materials which are urged by the extending compacting ram platen through the charging passage are compacted into a bale within the compaction chamber.

The compaction chamber of such conventional baling machines generally has a rectangular solid shape having predetermined dimensions, including a predetermined width. In addition to the front face of the compacting ram platen in the extended position, the compaction chamber is typically defined by a floor, a ceiling and an end wall, opposite the compacting ram platen, which are fixed in position. The compaction chamber is further defined by a pair of opposed sidewalls which are adapted to cooperatively move so as to eject a compacted bale. In particular, once a bale has been formed in the compaction chamber, the bale is ejected such that the next bale can be compacted. The ejected bale can then be strapped or banded prior to shipment.

Conventional baling machines generally include a discharge ram assembly having a discharge ram platen for ejecting a compacted bale. Typically, the discharge ram assembly moves from a retracted position in which the discharge ram platen forms a first sidewall of the compaction chamber to an extended position by advancing the discharge ram platen through the compaction chamber such that the compacted bale is ejected therefrom. Generally, the discharge ram platen is longitudinally advanced in a direction perpendicular to the longitudinal axis of the charging passage.

Conventional baling machines typically operate in one of two modes, namely, a separation mode and a plug bale mode. In the separation mode, the second sidewall of the compaction chamber includes a door which is closed during the compaction operations and which opens once the compacted bale has been formed such that the compacted bale can be ejected from the compaction chamber. The door can then be closed prior to compacting the next bale.

In the plug bale mode, the second sidewall of the compaction chamber also includes a door. However, the door remains open during compaction operations in the plug bale mode and the rear portion of a previously compacted plug bale fills the opening in the sidewall of the compaction chamber during the compaction of the succeeding bale. Once the succeeding bale has been compacted, it can be ejected into the opening, thereby urging the previously compacted bale which had previously plugged the opening in the compaction chamber further downstream of the baling machine. The most recently compacted bale remains at least partially within the opening, however, to serve as the plug bale by filling the opening in the sidewall of the compaction chamber during the compaction of the succeeding bale.

Regardless of the mode of operation, conventional baling machines generally operate at relatively high pressures in order to compact a variety of loose materials into bales of a predetermined size. For example, the compacting ram assembly of a conventional baling machine can generate forces of about 500,000 pounds up to about 1,000,000 pounds or more during the compaction process. Thus, the baling machine and, in particular, the housing of the baling machine must be adapted to withstand large forces generated during the compaction process. In addition, a conventional baling machine repeats the compaction process a large number of times in order to form a plurality of bales. Thus, the baling machinery and, in particular, the housing of the baling machine must be adapted to repeatedly withstand the relatively large forces generated during the compaction process.

Conventional baling machines can also include a knife assembly for separating the loose materials disposed within the charging passage from other loose materials, such as the portions of loose materials which extend upwardly through the opening in the upper panel and into the bin or hopper. By severing the loose materials which are disposed within the charging passage from other loose materials, a more well-defined bale is formed and the baling machine is not damaged. For example, by severing the loose materials which extend beyond the charging passage, the jamming of loose materials between the housing and the compacting ram platen and any resulting damage to the baling machine is averted.

The knife assembly of a conventional baling machine generally includes a first cutting edge attached to upper portions of the compacting ram platen and a second cutting edge mounted to an upper portion of the housings. The first and second cutting edges cooperate to sever the loose materials disposed within the charging passage from other loose materials as the compacting ram platen is moved forward through the charging passage and passes beneath the second cutting edge. In particular, as the compacting ram platen is moved longitudinally forward within the charging passage so as to pass beneath the second cutting edge, those materials which extend beyond the charging passage, such as loose materials which extend upwardly into the bin or hopper, are severed in a scissors-like action by the cooperating first and second cutting edges. In order to efficiently sever the loose materials, the first and second cutting edges are preferably aligned and are desirably spaced apart by a predetermined spacing or clearance. More specifically, for a conventional horizontal-type baling machine, the first and second cutting edges are preferably spaced apart by a predetermined vertical spacing.

In operation, however, the various components of a baling machine, including the first and second cutting edges, wear and deteriorate due to, among other things, repeated frictional contact between the loose materials and the various components of the baling apparatus. For example, the floor and ceiling of the housing can gradually wear or deteriorate. Likewise, the surface and edges of the compacting ram platen can wear following repeated compaction operations.

As the various components of the baling machine, including the first and second cutting edges, wear and deteriorate, the alignment of the first and second cutting edges as well as the spacing therebetween changes. Due to the changes in alignment and spacing between the first and second cutting edges, the efficiency with which the knife assembly of conventional baling machines severs the portions of the loose materials which extend beyond the charging passage typically decreases. This decrease in severing efficiency by the first and second cutting edges can increase the energy required to operate the baling machine and can decrease the definition of the compacted balers. Furthermore, the misalignment and spacing variances of the first and second cutting edges can also increase the likelihood that a component of the baling apparatus will be damaged, such as by an unsevered or partially severed portion of the loose materials which extend beyond from the charging passage becoming jammed, such as between the compacting ram platen and the housing, during compacting operations.

Consequently, various adjustable knife assemblies have been developed to control the spacing between the first and second cutting edges such that the loose materials extending beyond the charging passage continue to be effectively and efficiently severed from the loose materials collected within the charging passage. For example, baling machines having an adjustable ceiling panel or an adjustable floor panel have been developed. In these designs, the ceiling panel or the floor panel is generally connected to the remainder of the housing, such as by a plurality of bolts. In order to provide adjustment of the ceiling panel or the floor panel, a number of spacers or shims can be provided between the adjustable panel and the remainder of the housing. Thus, as the components of the baling machine wear and the spacing between the cutting edges varies, the adjustable panel can be disconnected from the housing and one or more spacers added or removed as appropriate. In particular, for a baling machine having an adjustable ceiling panel, the ceiling panel can be disconnected from the remainder of the housing and one or more spacers removed such that the ceiling panel is effectively lowered and the cutting edge spacing is decreased once the housing is reassembled. Alternatively, for a baling machine having an adjustable floor panel, the floor panel can be removed and one or more spacers added such that the floor panel is effectively raised and the cutting edge spacing is decreased once the housing is reassembled. In either instance, the spacing between the cutting edges can be controllably adjusted.

As will be apparent to those skilled in the art, however, the disassembly and reassembly of the housing is typically a laborious process which can significantly disrupt baling operations. In addition, the threaded engagement of the ceiling panel or the floor panel with the remainder of the housing and the insertion of a number of spacers or shims between the adjustable panel and the remainder of the housing can decrease the rigidity of the housing and, consequently, decrease the long term stability of the housing.

Another adjustable knife assembly is disclosed by U.S. Pat. No. 3,613,556 which issued Oct. 19, 1971 to Colin S. Wright, et al. and is assigned to American Hoist and Derrick Company. In particular, the adjustable knife assembly of this patent includes an adjustment screw and one or more spacers or shims to controllably position the cutting edge which is mounted to the housing such that the spacing between the first and second cutting edges is optimized. Accordingly, by loosening the adjustment screw and adding or removing shims as appropriate, the cutting edge which is mounted to the housing can be raised or lowered, respectively. As a result, the spacing between the first and second cutting edges can be controllably increased or decreased. However, the addition or removal of shims in order to alter the position of the cutting edge which is mounted to the housing also significantly disrupts baling operations. In addition, the use of an adjustment screw and one or more shims can also decrease both the rigidity and the long term stability of the housing as described above.

Consequently, other adjustable knife assemblies have been developed. For example, U.S. Pat. No. 3,003,411 which issued Oct. 10, 1961 to Sebastian F. Judd describes another baling machine having an adjustable knife assembly which includes a second cutting edge adjustably mounted to an upper portion of the housing which cooperates with a first cutting edge attached to an upper edge of the compacting ram platen so as to sever loose materials which extend beyond the charging passage. In particular, the knife assembly includes two sets of adjustment screws associated with the second cutting edge, namely, a first set of adjustment screws which raise the second cutting edge and a second set of adjustment screws which lower the second cutting edge. Thus, by engaging either the first or the second set of adjustment screws, the second cutting edge can be controllably raised or lowered, respectively. Once the second cutting edge has been properly positioned to establish the desired spacing with the first cutting edge, set screws can be engaged which lock the second cutting edge in position and fix the clearance between the first and second cutting edges.

In addition, U.S. Pat. No. 5,351,613 which issued Oct. 4, 1994 to Horace R. Newsom and is assigned to Harris Waste Management Group, Inc. also discloses a baling machine having an adjustable knife assembly including first and second cutting edges attached to the compacting ram platen and upper portions of the housing, respectively. The second cutting edge of this design can be controllably repositioned, relative to the first cutting edge, to obtain the desired spacing between the first and second cutting edges.

In particular, the knife assembly of U.S. Pat. No. 5,351,613 includes a knife carrier for supporting the second cutting edge along a lower edge. The knife assembly also includes first and second support plates which are attached to upper portions of the housing and which sandwich the knife carrier therebetween. Thus, the knife carrier is movably positioned between the first and second support plates. The knife assembly of U.S. Pat. No. 5,351,613 also includes a pair of adjusting assemblies disposed between the first and second support plates for adjusting the vertical position of the knife carrier and, in turn, the position of the second cutting edge secured thereto. Thus, the spacing between the first and second cutting edges can be adjusted to compensate for wear of the various components of the baling machine.

However, the movement of the knife carrier and, consequently, the second cutting edge relative to the housing and the first cutting edge is limited to vertical motion, and does not include lateral or horizontal movement. Thus, the lateral position of the second cutting edge of the adjustable knife assembly is fixed. In addition, by sandwiching the knife carrier and the second cutting edge between the first and second support plates, access to the knife carrier and the second cutting edge is limited without disassembling the knife assembly. Consequently, inspection, repair and replacement of the knife carrier and, in particular, the second cutting edge is difficult, if not impossible, without disassembling the knife assembly.

SUMMARY OF THE INVENTION

It is therefore an object of the present invention to provide an improved apparatus for baling loose materials.

It is another object of the present invention to provide an apparatus for baling loose materials which is reinforced so as to repeatedly withstand the relatively large forces generated during the compaction process.

It is a further object of the present invention to provide an apparatus for baling loose materials which has an improved knife assembly that is adjustable so as to control the cutting spacing.

It is yet another object of the present invention to provide an improved method for fabricating an apparatus for baling loose materials.

These and other objects are provided, according to the present invention, by an apparatus for baling loose materials, such as waste materials, and an associated method for fabricating the apparatus for baling loose materials. In one embodiment, the baling apparatus includes a first reinforcing frame disposed generally circumferentially about at least a portion of the housing of the baling apparatus to structurally reinforce the housing during the compaction of a bale. In another embodiment, the baling apparatus includes a compacting ram platen having a first cutting edge disposed along man upper edge thereof, a knife assembly having a second cutting edge adjustably mounted to upper portions of the housing, and a lateral guide for controlling the lateral position of the second cutting edge. Thus, bath the clearance between and the lateral alignment of the first and second cutting edges can be controlled according to this embodiment of the present invention.

The apparatus for baling loose materials generally includes a housing having a floor panel and first and second opposed side panels. The housing also typically includes an upper panel defining an opening therein for receiving the loose materials. The housing defines a charging passage, such as a longitudinally extending charging passage, which is in communication with the opening defined in the upper panel so as to collect the loose materials received through the opening defined in the upper panel. The housing also defines a compaction chamber in communication with an exit end of the charging passage.

The baling apparatus of the present invention also includes a compacting ram assembly disposed at least partially within the charging passage and adapted for movement, such as reciprocal longitudinal movement, therein. The compacting ram assembly includes a compacting ram platen for urging the loose materials which are collected within the charging passage through the charging passage and into the compaction chamber, and for compacting the loose materials within the compaction chamber into a bale.

According to one embodiment, the baling apparatus of the present invention also preferably includes a first reinforcing frame disposed generally circumferentially about at least a portion of the housing and having an aperture defined therethrough. During fabrication, the first and second side panels and, in most instances, the floor panel are preferably extended through the aperture defined by the first reinforcing frame. The aperture defined by the first reinforcing frame is preferably sized to support the floor panel and the first and second opposed side panels in a predetermined positional relationship.

Thereafter, first and second laterally opposed edge portions of the floor panel can be joined to the first and second side panels, respectively, to form the housing. The first reinforcing frame, which extends generally circumferentially about at least a portion of the housing, can also be joined to the housing to structurally reinforce the housing during the compaction of a bale. In addition, the upper panel can also be joined to the first and second opposed side panels and to the first reinforcing frame to further structurally reinforce the housing during the compaction of the bale.

According to one embodiment of the present invention, the first reinforcing frame is disposed circumferentially about a portion of the housing downstream of the opening defined by the upper panel of the housing. In a more specific embodiment, the first reinforcing frame is disposed circumferentially about the portion of the housing which defines the exit end of the charging passage and which is generally subjected to the greatest forces during the compaction process.

The baling apparatus of this embodiment also can include a second reinforcing frame spaced apart from the first reinforcing frame and defining an aperture through which the floor panel and the first and second opposed side panels extend. The second reinforcing frame is therefore also disposed generally circumferentially about a portion of the housing defined by the floor panel and the first and second opposed side panels so as to provide additional structural reinforcement to the housing during the compaction of a bale.

According to another embodiment of the present invention, the compacting ram platen has a first cutting edge disposed along an upper edge thereof. The baling apparatus of this embodiment also includes a knife assembly for cooperating with the first cutting edge to sever the loose materials within the charging passage from other loose materials, such as the portions of the loose materials which extend beyond the charging passage.

The knife assembly generally includes a frame member mounted to the housing at a location proximate the opening defined by the upper panel. The knife assembly also includes a second cutting edge attached to the frame member and adapted for adjustable movement relative to the frame member such that the spacing between the first and second cutting edges can be controlled. Further, the knife assembly includes a lateral guide, attached to the frame member, for controlling the lateral position of the second cutting edge such that the first and second cutting edges can be controllably aligned.

The knife assembly of this embodiment can also include a knife support to which the second cutting edge is attached. The knife support is preferably adjustably attached to the frame member and, in preferred embodiments, includes an adjustment member for adjusting the position of the knife support relative to the frame member to thereby control the relative spacing between the first and second cutting edges.

The knife support includes laterally opposed edge portions. In one embodiment, the lateral guide includes first and second lateral guide members positioned adjacent respective edge portions of the knife support. The first and second lateral guide members maintain the proper lateral position of the second cutting edge as the knife support is adjusted relative to the frame member. For example, the first and second guide members can include prismatic guides having a predetermined exterior shape and the laterally opposed edge portions of the knife support can have a predetermined shape which corresponds to the predetermined exterior shape of the adjacent prismatic guides. The first and second guide members can also include lateral adjustment means for laterally adjusting the prismatic guides relative to the frame member such that the lateral position of the knife carrier can be further controlled.

In one embodiment, the frame member can include the first reinforcing frame which is disposed generally circumferentially about at least a portion of the housing and which structurally reinforces the housing during the compaction of a bale. The first reinforcing frame typically includes an upper frame portion and first and second opposed side frame portions extending downwardly from respective ends of the upper frame portion. In this embodiment, the second cutting edge is preferably attached to the upper frame portion of the first reinforcing frame. The knife assembly can also include a second reinforcing frame spaced apart from the first reinforcing frame and disposed generally circumferentially about a portion of the housing defined by the floor panel and the first and second opposed side panels.

Further, the knife assembly can include release means for controllably releasing the second cutting edge upon the application of forces to the second cutting edge which exceed a predetermined maximum force. In one embodiment, the release means includes an interconnecting member extending between the first and second reinforcing frames. The interconnecting member defines a center aperture between the first and second reinforcing frames. In this embodiment, the release means also includes the adjustment member for adjusting the position of the second cutting edge relative to the first reinforcing frame. In particular, the adjustment member preferably extends through the center aperture defined by the interconnecting member and is positionally engaged therewith.

In addition, the release means can include separation means connectably engaging the interconnecting member and the first and second reinforcing frames. The separation means is adapted to disengage upon the application of forces to the second cutting edge which exceed the predetermined maximum force. Thus, the interconnecting member, the adjustment member and the second cutting edge can move in response to the applied forces so as to thereby diminish the forces on the second cutting edge and to protect the baling apparatus from damage.

Therefore, according to one embodiment of the present invention, the baling apparatus includes a first reinforcing frame disposed generally circumferentially about at least a portion of the housing to structurally reinforce the housing during the compaction of a bale. Accordingly, the rigidity of the baling apparatus and, in particular, the housing is increased such that the baling apparatus can repeatedly withstand the relatively high forces generated during the compaction of a bale. In addition, the first reinforcing frame facilitates the fabrication of a baling apparatus by providing a jig or assembly device to support the floor panel and first and second opposed side panels in a predetermined positional relationship during the assembly of the housing. In another embodiment, the baling apparatus includes an adjustable knife assembly having a second cutting edge which can be controllably adjusted both vertically and laterally, relative to the first cutting edge, so as to efficiently sever loose materials which extend beyond the charging passage.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
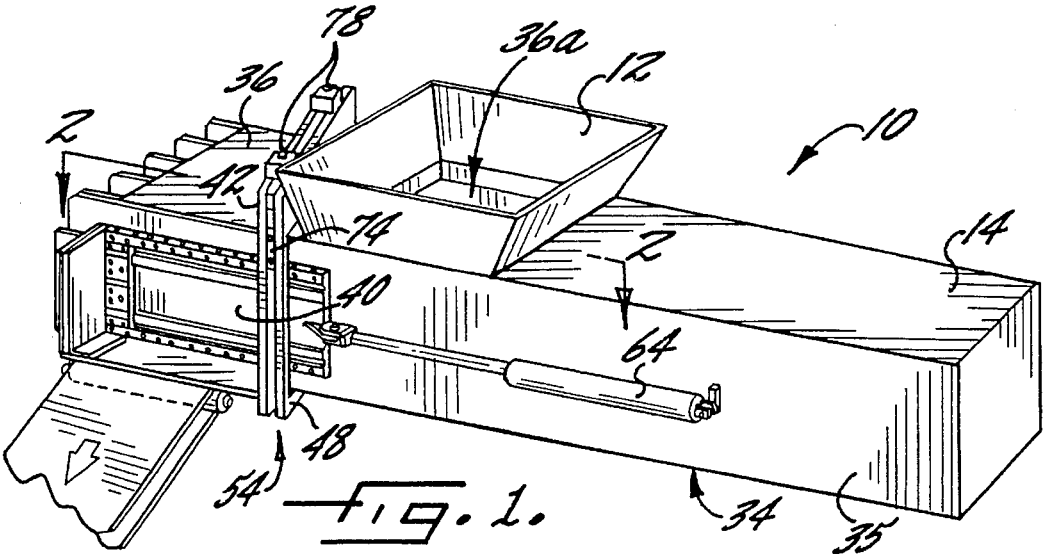
FIG. 1 is a perspective view of an apparatus for baling loose materials according to one embodiment of the present invention.
Figure 2:
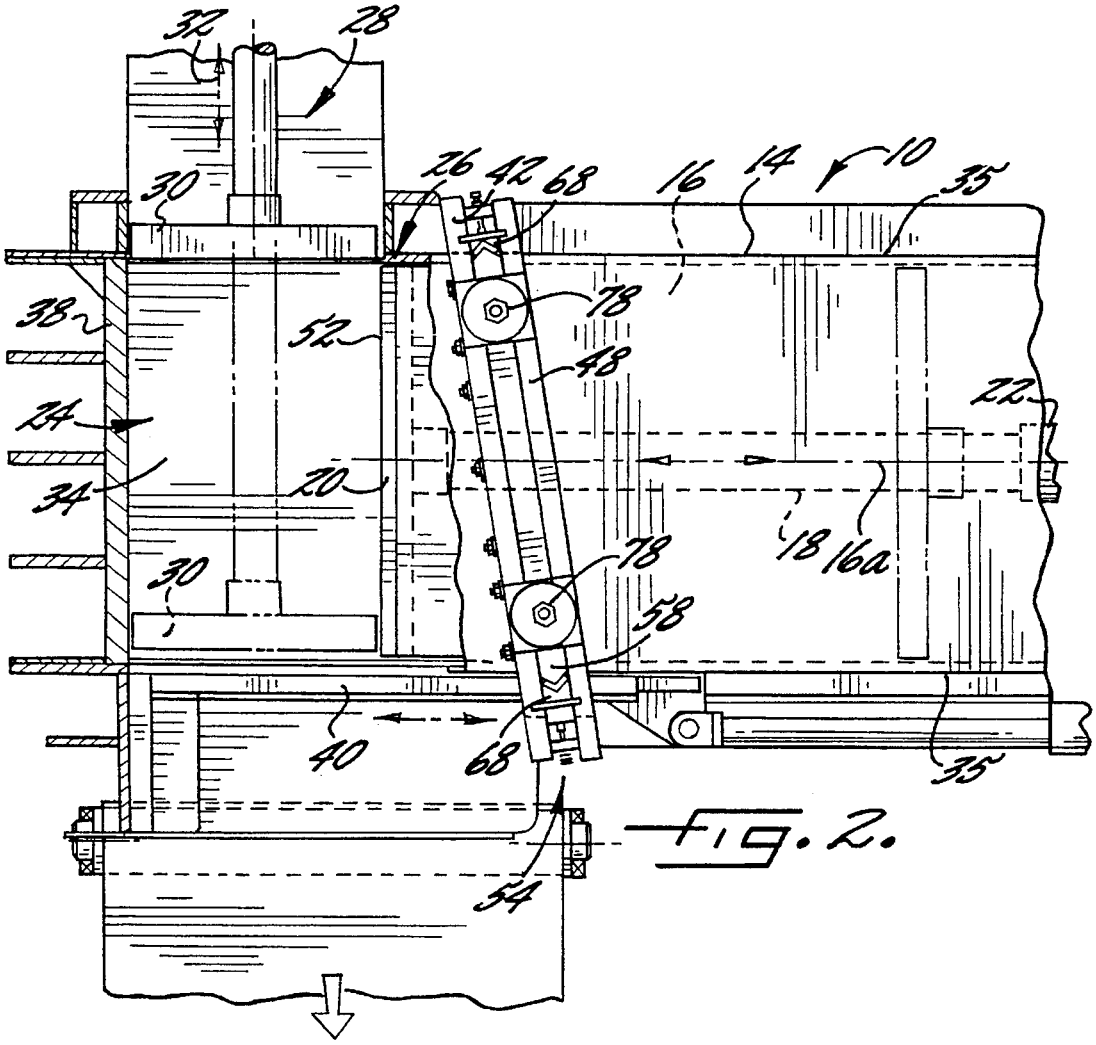
FIG. 2 is a fragmentary perspective view of the baling apparatus of the FIG. 1 taken along line 2—2 and illustrating the extended and retracted positions of both the compacting ram assembly and the discharge ram assembly.

Referring now to FIGS. 1 and 2, an apparatus 10 for baling loose materials, such as waste materials, according to the present invention is illustrated. The baling apparatus includes a bin or hopper 12 into which loose materials, such as recyclable waste materials including cans, plastics and paper, can be deposited. The hopper is generally mounted to an upper portion of the housing 14 of the baling apparatus and is in communication with a charging passage 16 defined within the housing such that the charging passage receives the loose materials which are deposited within the hopper. As shown in more detail in FIG. 2, the charging passage of one embodiment extends longitudinally through the housing and defines a longitudinal axis 16*a* therethrough. Typically, the charging passage has a parallelepiped shape and, more typically, has a rectangular solid shape.

The housing 14 generally includes a floor panel 34 and first and second side panels 35 which extend upwardly from opposed edge portions of the floor panel. In addition, the housing generally includes an upper panel 36 defining an opening 36*a* which is in communication with the charging passage 16. In addition, the bin or hopper 12 is preferably mounted about the opening defined in the upper panel such that loose materials deposited in the bin or hopper are collected within the charging passage.

A compacting ram assembly 18 can be disposed at least partially within the charging passage 16. The compacting ram assembly generally includes a compacting ram platen 20 which is adapted for movement, such as longitudinal movement, through the charging passage between a retracted position and an extended position. For illustrative purposes, the compacting ram platen in the extended position is shown in solid lines in FIG. 2 and the compacting ram platen in the retracted position is shown in dotted lines. The compacting ram platen is typically hydraulically actuated. Thus, the compacting ram assembly also generally includes a longitudinally extending hydraulic cylinder 22 and a hydraulic pressure source (not illustrated) for actuating the compacting ram platen.

As the compacting ram platen 20 moves longitudinally forward from the retracted position to the extended position, the loose materials which are received within the charging passage 16 are urged into a compaction chamber 24. As also illustrated in FIG. 2, the compaction chamber is defined within the housing 14 and is in communication with an exit end 26 of the charging passage. The longitudinally forward movement of the compacting ram platen not only urges the loose materials into the compaction chamber, but also compacts loose materials into a bale. Typically, the compacting ram assembly reciprocates within the charging passage such that additional loose materials are received within the charging passage while the compacting ram assembly is in the retracted position. The additional materials can then be added to the bale during the next longitudinally forward movement of the compacting ram platen.

The baling apparatus 10 of the present invention also generally includes discharge means, such as a discharge ram assembly 28 which is at least partially disposed within the compaction chamber 24. The discharge ram assembly includes a discharge ram platen 30 which is adapted to move through the compaction chamber between a retracted position and an extended position. For purposes of illustration, the discharge ram platen in the retracted position is shown in solid lines in FIG. 2 and the discharge ram platen in the extended position is shown in dotted lines. In particular, the discharge ram assembly generally moves in a direction indicated by arrow 32 which is substantially perpendicular to the longitudinal axis 16*a* of the charging passage 16. By moving the discharge ram platen through the compaction chamber from the retracted position to the extended position, the compacted bale can be ejected as described hereinafter. Although not illustrated, the discharge ram assembly is preferably hydraulically actuated and can therefore also include a hydraulic cylinder and an associated hydraulic pressure source.

The compaction chamber 24 is generally defined by the floor panel 34, the upper panel 36 and an end wall 38, each of which are typically fixed in position. In addition, the front surface of the compacting ram platen 20 in the extended position generally defines a wall of the compaction chamber, opposite the fixed end wall. Furthermore, a first sidewall of the compaction chamber is generally formed by the front surface of a discharge ram platen 30 of a discharge ram assembly 28 in the retracted position.

The baling apparatus 10 of the present invention can operate in either a separation mode or a plug bale mode. In the separation mode, a second sidewall of the compaction chamber 24, opposite the front face of the discharge ram platen 30, is formed by a movable door 40. The door is closed during compaction operations and is adapted to open following the compaction of a bale to allow the compacted bale to be ejected through the opening thereby exposed in the compaction chamber. For example, the door can also be hydraulically activated, such as by hydraulic cylinder 64. The door can then be closed prior to the compaction of the succeeding bale.

Alternatively, in the plug bale mode, a previously compacted plug bale is held within the opening from the compaction chamber 24 defined by the open door 40 during the compaction of a succeeding bale. Consequently, the second sidewall of the compaction chamber, opposite the front face of the discharge ram platen 30, is formed, at least partially, by a rear portion of the plug bale filling the opening defined by the open door.

Regardless of the mode of operation, the baling apparatus 10 of one embodiment of the present invention includes a first reinforcing frame 42 disposed generally circumferentially about at least a portion of the housing 14 and having an aperture 44 defined therethrough. In particular, while a generally rectangular reinforcing frame is illustrated and described hereinafter, the first reinforcing frame could be generally U-shaped so as to extend about the upper panel 36 and the first and second opposed side panels 35 of the housing. Furthermore, while the illustrated first reinforcing frame extends circumferentially along and about the entire housing, the first reinforcing frame need not be disposed adjacent to all portions of the housing, but, instead, need only be disposed generally circumferentially about the housing.

As shown, however, the first reinforcing frame 42 is preferably disposed circumferentially about the housing 14. In particular, the first and second opposed side panels 35 and, in some embodiments, the floor panel 34 of the housing are preferably extended through the aperture during fabrication of the baling apparatus. The aperture defined by the first reinforcing frame is preferably sized to support the floor panel and the first and second opposed side panels in a predetermined positional relationship, that is, the first reinforcing frame supports the first and second side panels in an upwardly extending position from opposed edge portions of the floor panel.

Figures 3, 4:
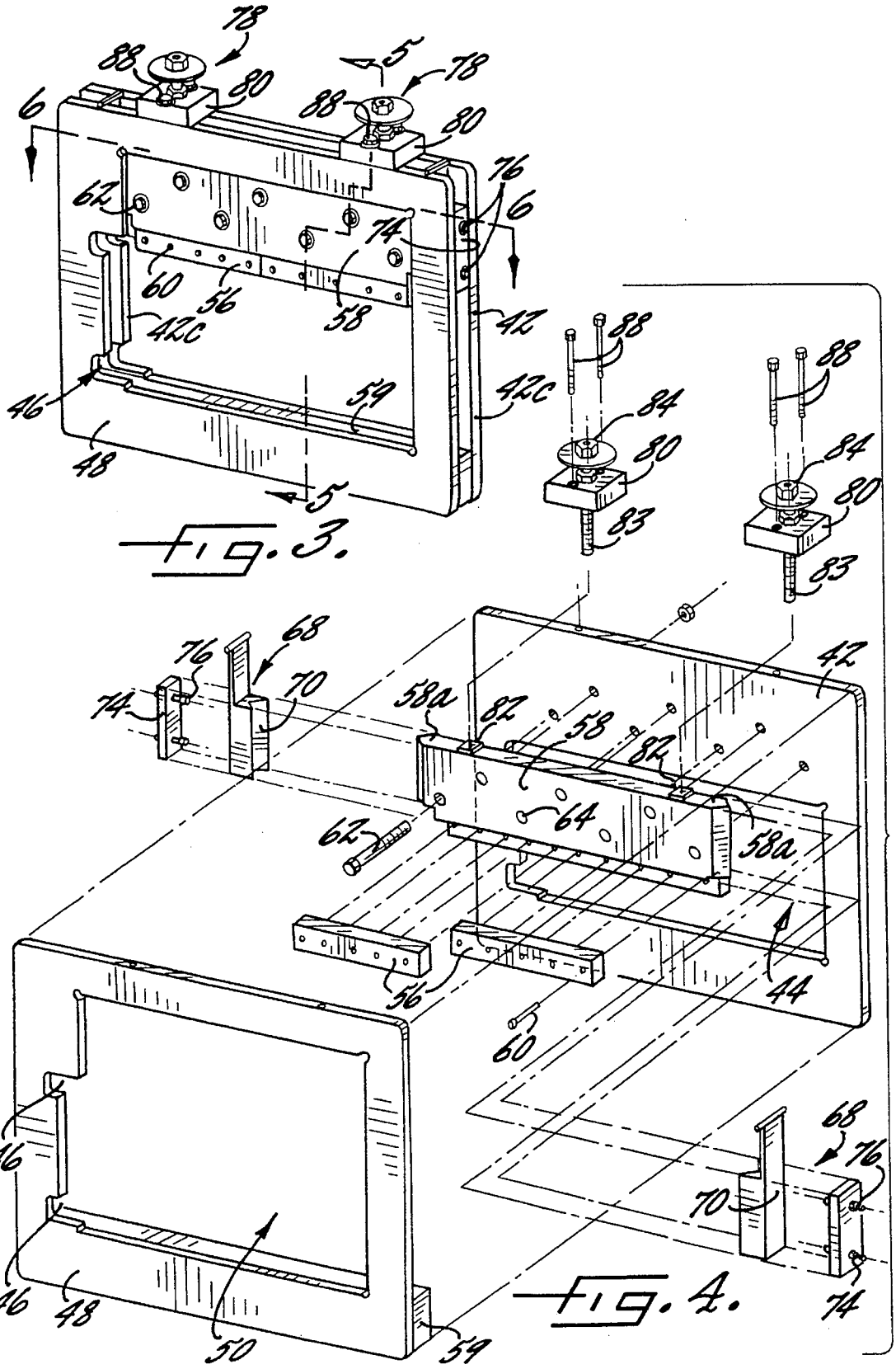
FIG. 3 is a perspective view of the knife assembly of one embodiment of the present invention.
FIG. 4 is an exploded perspective view of the knife assembly of the embodiment of the present invention illustrated in FIG. 3.
Figure 5:
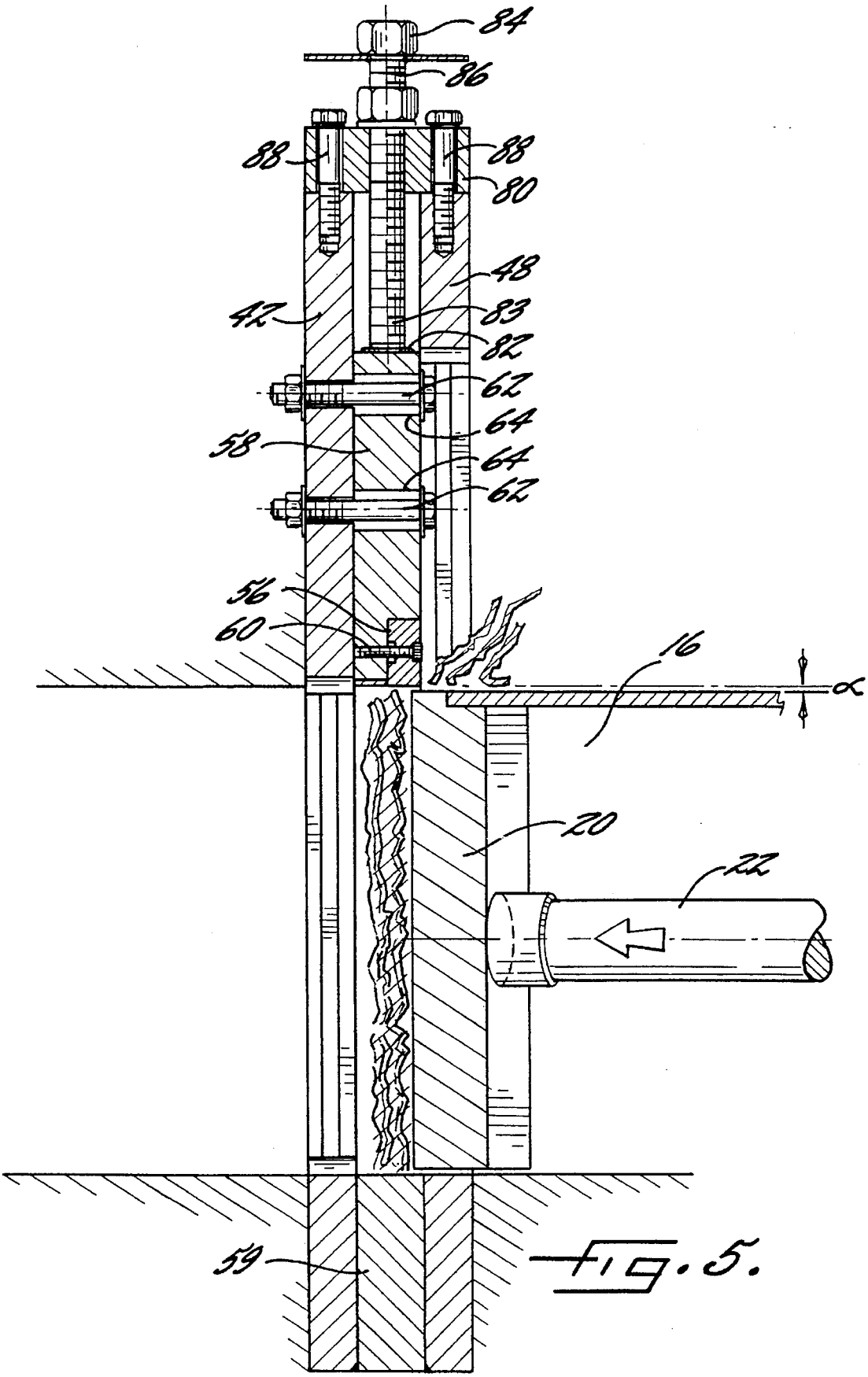
FIG. 5 is a cross-sectional view of the knife assembly of the embodiment of the present invention of FIG. 3 taken along line 5—5.

As shown in FIGS. 3–5, the aperture 44 defined by the first reinforcing frame 42 generally has the same shape as the shape of the charging passage 14 in lateral cross-section, such as a generally rectangular shape in the illustrated embodiment. In addition, the aperture defined by the first reinforcing frame can include enlarged corner portions 46, as best illustrated in FIGS. 3–5, through which guide rails 41 that are disposed horizontally along an outer surface of the moveable door 40 can extend.

Once arranged within the aperture 44 of the first reinforcing frame 42 in the predetermined positional relationship, the floor panel 34 and the first and second opposed side panels 35 can be joined, such as by welding, to form the integral housing 14 which defines the charging passage 16 therein. In particular, first and second laterally opposed edge portions of the floor panel can be joined to the first and second side panels, respectively. The first reinforcing frame is also preferably joined, such as by welding, to the housing during the fabrication process. Furthermore, the upper panel 36 of the housing can also be joined to the first reinforcing frame and to the first and second side panels during the fabrication of the baling apparatus 10 such that the housing is further structurally reinforced.

As illustrated in FIGS. 1 and 2, the first reinforcing frame 42 is disposed circumferentially about the housing 14 so as to structurally reinforce the housing during the compaction of a bale. In particular, the first reinforcing frame is generally formed from a integral metallic sheet having a predetermined thickness. For example, the first reinforcing frame can be formed of steel or a steel alloy and can have a thickness of at about 3 inches or more. In addition, the width of the various frame portions of the first reinforcing frame are preferably greater than a predetermined minimum width, such as greater than about 2.5 inches for a reinforcing frame having a thickness of about 3 inches or more and a compacting ram assembly 18 capable of generating from about half a million pounds of force up to about one million pounds of force or more. Thus, by circumferentially enclosing and structurally reinforcing the housing, the baling apparatus 10 of the present invention and, in particular, the housing can repeatedly withstand the relatively large forces generated during the compaction of a bale. Accordingly, the baling apparatus can have a relatively long operational life.

The first reinforcing frame 42 is preferably disposed about a portion of the housing 14 which is subjected to the greatest amounts of force during the compaction process. Thus, the reinforcing frame is preferably disposed circumferentially about a portion of the housing proximate the opening 36*a* defined by the upper panel 36 of the housing and, more preferably, is disposed between the opening defined by the upper panel and the portion of the housing which defines the compaction chamber 24. More specifically, the first reinforcing frame is preferably disposed longitudinally downstream of the opening defined in the upper panel of the housing. Thus, the forces generated by the compaction of the loose materials due to the longitudinally forward movement of the compacting ram platen 20 can be supported by the first reinforcing frame.

In one more specific embodiment, the first reinforcing frame 42 can be preferably disposed circumferentially about the portion of the housing 14 which defines the exit end of the charging passage 16. As illustrated in FIGS. 1 and 2, the exit end of the charging passage and, consequently, the first reinforcing frame of this embodiment can be adjacent to and immediately downstream of the opening 36*a* defined by the upper panel 36 through which loose materials are received. The first reinforcing frame is preferably disposed about the portion of the housing defining the exit end since this portion of the housing is generally subjected to the greatest amounts of force during the compaction process.

In order to provide additional structural reinforcement for the housing, the baling apparatus 10 of one embodiment of the present invention can also include a second reinforcing frame 48 having an aperture 50 through which the floor panel 34 and the first and second opposed side panels 35 also extend. As best shown in FIGS. 3–5, the aperture defined by the second reinforcing frame can also have enlarged corner portions 46 through which the guide rails 41 of the moveable door 40 can extend. Thus, the second reinforcing frame is also disposed generally circumferentially about at least a portion of the housing 14 defined by the first and second opposed side panels and, in some embodiments, the floor panel. Preferably, the second reinforcing frame is spaced apart from the first reinforcing frame 42 to provide additional structural reinforcement to the housing. However, the second reinforcing frame can be positioned adjacent the first reinforcing frame without departing from the spirit and scope of the present invention. As described above, in conjunction with the first reinforcing frame, the housing and, in particular, the floor panel and the first and second opposed side panels can be joined, such as by welding, to the second reinforcing frame to further structurally reinforce the housing.

In another embodiment of the baling apparatus 10 of the present invention, the compacting ram platen 20 includes a first cutting edge 52 disposed along an upper edge thereof. The baling apparatus of this embodiment also includes a knife assembly 54 for cooperating with the first cutting edge to sever portions of the loose materials within the charging passage 16 from other portions of the loose materials, such as portions of the loose materials which extend outwardly through the opening 36*a* defined by the upper panel 36. Thus, a well-defined bale of compacted material can be formed without requiring additional force and energy to compact loose materials not fully within the charging passage and without potentially damaging the baling apparatus by attempting to compact materials extending beyond the charging passage.

The knife assembly 54 preferably includes a frame member 42 attached to the housing 14 at a location proximate the opening 36*a* defined by the upper panel 36 and, more preferably, between the opening defined by the upper panel and the compaction chamber 24. In other words, the frame member is mounted to a portion of the housing longitudinally downstream of the opening defined by the upper panel. As illustrated, the frame member can include the first reinforcing frame and can be mounted immediately downstream of and adjacent to the opening defined by the upper panel.

As illustrated in FIGS. 3–5, the knife assembly 54 of this embodiment also includes a second cutting edge 56 attached to the frame member 42 and adapted for adjustable movement relative to the frame member. Thus, the relative spacing or clearance between the first and second cutting edges can be controlled. In particular, for a horizontal-type baling apparatus 10 as shown, the second cutting edge is generally adapted for relative vertical movement such that the vertical spacing between the first and second cutting edges can be controlled and can be maintained at a predetermined spacing, such as about 4–5 thousands of an inch, such that the loose materials extending beyond the charging passage 16 are efficiently and effectively severed.

Figure 7:
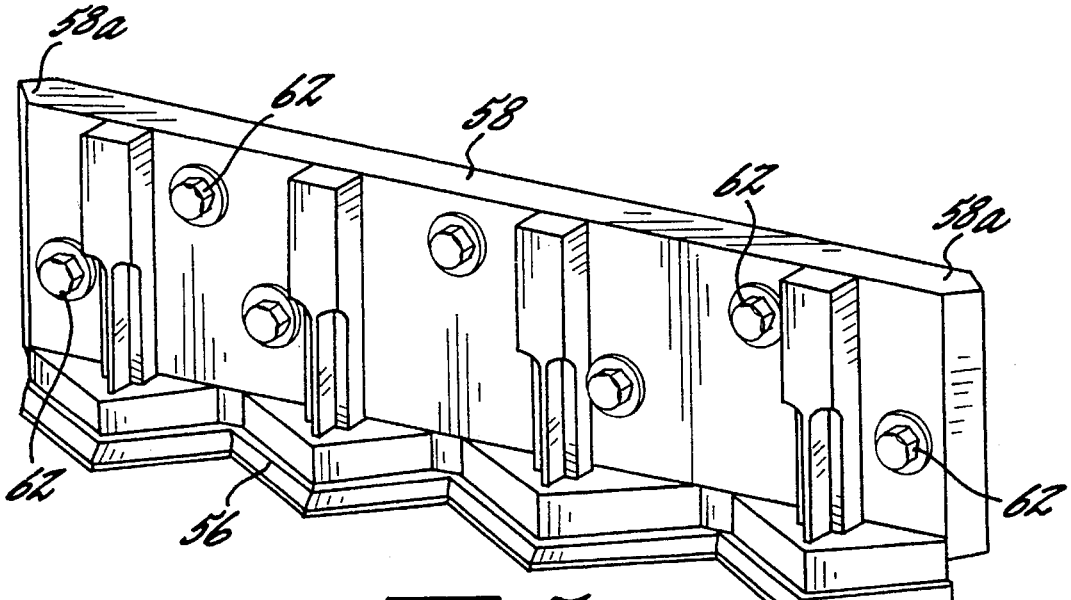
FIG. 7 is a perspective view of a knife support having a serrated cutting edge mounted along a lower edge portion thereof according to one embodiment of the present invention.

The second cutting edge 56 can include one or more cutting knives attached to the frame member 42 in an aligned relationship and, in some embodiments, can include a serrated cutting edge as shown in FIG. 7. The knife assembly 54 of this embodiment can also include a knife support 58 to which the second cutting edge is attached. As illustrated in FIGS. 3–5, the second cutting edge is preferably attached to a lower edge portion of the knife support, such as by a plurality of screws 60 which extend through the second cutting edge and into the knife support. As also illustrated, a wear strip 57 can also be attached to the lower edge portion of the knife support to facilitate relative movement between the knife support and the first cutting edge 52.

In this embodiment, the knife support 58 is adjustably attached to the frame member 42 such that the relative spacing between the first and second cutting edges can be controllably varied. In particular, the knife support can be attached to the frame member such as by a plurality of connecting members 62, such as bolts, which extend through a plurality of respective holes 64 defined by the knife support and into the frame member. As best illustrated in cross-section in FIG. 5, the holes defined by the knife support preferably have a diameter larger than the diameter of the respective connecting member such that the knife support can be adjusted both vertically and laterally relative to the fixed positions of the frame member and the connecting members.

As explained in detail below, the knife assembly 54 can also include at least one adjustment member 66 for adjusting the position of the knife support 58 relative to the frame member 42 to thereby control the relative spacing between the first and second cutting edges. Preferably, the relative spacing between the first and second cutting edges is maintained within the predetermined range of spacings such that the loose materials are efficiently severed as the compacting ram platen 20 which includes the first cutting edge 52 moves by the second cutting edge 56. Typically, the compacting ram platen and the first cutting edge pass beneath the second cutting edge within the charging passage 16.

In order to further improve the efficiency with which the loose materials are severed by the first and second cutting edges, the knife assembly 54 and, in particular, the frame member 42 to which the second cutting edge 56 is mounted, is preferably disposed at a predetermined angle, such as 9°, relative to the first cutting edge 52 which generally extends laterally across the longitudinal charging passage 16 in a direction substantially perpendicular to the longitudinal axis 16*a* of the charging passage. Thus, the loose materials can be more efficiently severed in a scissors-like action by the angularly offset first and second cutting edges.

Figure 6:
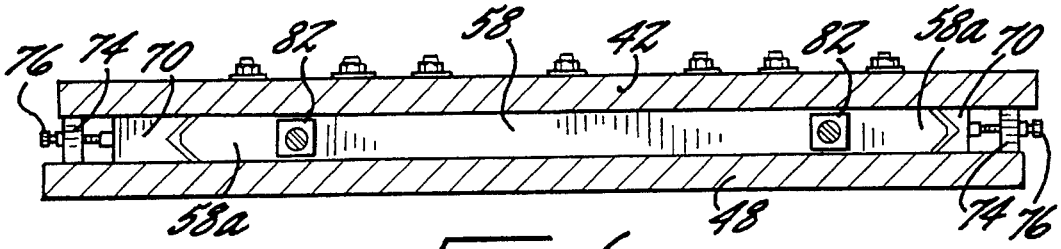
FIG. 6 is a cross-sectional top view of the knife assembly of the embodiment of the present invention of FIG. 3 taken along line 6—6.

The knife assembly 54 of the present invention also preferably includes a lateral guide 68, mounted to them frame member 42, for controlling the lateral position of the second cutting edge 58. Thus, the first and second cutting edges can be controllably aligned. More specifically, the knife support 58 generally includes laterally opposed edge portions 58*a* as shown in FIGS. 4 and 6. In addition, the lateral guide of this embodiment preferably includes first and second lateral guide members positioned adjacent a respective edge portion of the knife support and adapted to maintain proper lateral position of the second cutting edge as the knife support is adjusted relative to the frame member.

As illustrated in FIGS. 4 and 6, the first and second guide members can each include a prismatic guide 70 having a predetermined exterior shape, such as a generally pointed or triangular cross-sectional shape. Likewise, the laterally opposed edge portions 58*a* of the knife support 58 also preferably have a predetermined shape which corresponds to the predetermined exterior shape of the adjacent prismatic guide. For example, in the illustrated embodiment, each prismatic guide has a generally pointed shape while each respective edge portion of the knife support has a corresponding indentation adapted to receive and mate with the prismatic guide. Consequently, the prismatic guides of the first and second guide members control the lateral positions of the knife support and, in turn, the second cutting edge relative to both the frame member 42 and to the first cutting edge 52 such that the first and second cutting edges can cooperate to efficiently sever the loose materials extending beyond the charging passage 16.

The first and second guide members can also each include adjustment means for laterally adjusting the respective prismatic guide 70 relative to the frame member 42. As illustrated in FIGS. 4 and 6, the adjustment means can include a fixed member 74 attached to the frame member and defining at least one aperture therethrough. The adjustment means can also include a lateral adjustment member 76, such as a bolt, which extends through the aperture defined by the fixed member and which is threadably engaged therewith. By controllably positioning the lateral adjustment member relative to the fixed member and, consequently, the frame member, the lateral position of the prismatic guide and, in turn, the lateral positions of the knife support 58 and the second cutting edge 56 can be further adjusted and controlled.

As described above, the frame member 42 can include the first reinforcing frame which extends generally circumferentially about at least a portion of the housing 14 and provides structural reinforcement to the housing during the compaction of a bale. As illustrated, the first reinforcing frame includes an upper frame portion 42*a* and first and second opposed side frame portions 42*c* which extend downwardly from respective ends of the upper and lower frame portions. The first reinforcing frame can also include a lower frame portion 42*b* extending between the first and second side frame portions. As also illustrated, the second cutting edge 56 is preferably attached to the upper frame portion of the first reinforcing frame and is adapted for controlled movement relative to the upper frame portion.

However, the frame member 42 can, instead, be shaped and sized differently without departing from the spirit and scope of the present invention. For example, the frame member can be generally wedge-shaped and can be positioned adjacent to and longitudinally downstream of the knife assembly 54 so as to support the knife assembly during compacting operations.

As also described above, the knife assembly 54 can include a second reinforcing frame 48 spaced apart from the first reinforcing frame 42 and disposed generally circumferentially about the portion of the housing 14 defined by the floor panel 34 and the first and second opposed side panels 35 so as to further structurally reinforce the housing during the compaction of a bale. As illustrated, however, the aperture defined through the second reinforcing frame is preferably larger than the aperture defined through the first reinforcing frame.

Due, at least in part to the increased rigidity and stability provided by the first reinforcing frame 42 and, in some embodiments, the second reinforcing frame 48, the knife assembly 54 need not be sandwiched between the first and second reinforcing frames. Instead, the aperture defined by the second reinforcing frame is preferably sized such that the second reinforcing frame does not overlap the knife support 58 when the knife support is in a cutting position, that is, when the lower edge portion of the knife support or, in the illustrated embodiment, when the wear strip 57 is aligned within or extends downwardly beyond a lower portion of the upper frame portion 42*a* of the first reinforcing frame. Consequently, the knife support and, in particular, the second cutting edge 56 can be readily accessed. Thus, the knife support and the second cutting edge can be efficiently inspected, repaired or replaced without disassembling the knife assembly.

As best illustrated in FIGS. 4 and 5, a spacing bar 59, also typically comprised of steel or a steel alloy, can be disposed between lower frame portions of the first and second reinforcing frames 42 and 48, respectively, to further increase the structural integrity of the housing 14 and the frame structure. For example, the spacing bar can be joined, such as by welding, to both the first and second reinforcing frames. Preferably, the spacing bar has the same thickness as the knife support 58, such as 4 inches in one embodiment, such that the first and second reinforcing frames are vertically aligned.

As also illustrated in FIGS. 3–5, the knife assembly 54 can include release means 78 for controllably releasing the second cutting edge 56 upon the application of forces to the second cutting edge which exceed a predetermined maximum force. For example, the predetermined maximum force of one embodiment can be approximated by the maximum compaction force generated by the compacting ram assembly 18, such as about 500,000 pounds up to about 1,000,000 pounds or more in one exemplary embodiment. Therefore, damage to the baling apparatus 10 can be prevented by allowing the knife support 58 and the second cutting edge to move, typically upwardly, so as to relieve the excessive forces prior to structurally failing.

In the illustrated embodiment, the release means 78 includes at least one interconnecting member 80 extending between the spaced apart first and second reinforcing frames 42 and 48, respectively. The interconnecting member preferably defines a center aperture disposed between the first and second apertures.

The release means 78 can also include the adjustment member 66, such as a threaded stud, for adjusting the position of the second cutting edge 56 relative to the first reinforcing frame 42. In particular, the adjustment member preferably extends through a center aperture defined by the interconnecting member 80 between the first and second reinforcing frames. The adjustment member is preferably positionally engaged with the interconnecting member and, in some embodiments, is threadably engaged with the interconnecting member.

In addition, a first end 83 of the adjustment member 66 preferably abuts an upper edge portion of the knife support 58. As illustrated, the upper edge portion of the knife support can include a contact pad 82 aligned with the adjustment member and formed of a relatively hard material, such as a relatively hard steel alloy, so as to prevent significant wear or deterioration due to repeated contact with the first end of the adjustment member.

A vertical adjustment element 84, such as a nut, can also be threadably engaged by a second end 86 of the adjustment member 66. More specifically, the vertical adjustment member is preferably threadably engaged to a portion of the adjustment member which is disposed on an opposite side of the interconnecting member 80 from the knife support 58.

Thus, the position, such as the vertical position, of the knife support 58 and the second cutting edge 56 can be precisely controlled. In particular, the connecting members 62, the lateral adjustment members 76 and the vertical adjustment element 84 are initially loosened such that the knife support can move relative to the first reinforcing frame 42. The adjustment member 66 can then be lowered, such as be rotating the second end 86 of the adjustment member, such that the knife support and the second cutting element is lowered. Once the knife support has been properly positioned, the connecting members, the lateral adjustment members and the vertical adjustment element can be tightened such that the position of the second cutting edge and the spacing between the first and second cutting edges is set. Accordingly, the spacing between the first and second cutting edges can be precisely controlled according to the present invention.

The release means 78 also includes separation means connectably engaging the first and second reinforcing frames 42 and 48, respectively, and the interconnecting member 80. Upon the application of forces to the second cutting edge 56 which exceed the predetermined maximum force, the separation means is adapted to disengage the interconnecting member and the first and second reinforcing frames. Thus, the interconnecting member, the adjustment member 66 and the knife support 58, including the second cutting edge, can move in response to the application of excessive forces so as to thereby diminish the forces to which the second cutting edge is subjected and to prevent damage to the baling apparatus 10 due to the excessive forces.

In particular, the knife support 58 of the present invention is allowed to move upwardly by the separation of the separation means to a position in which the connecting members 62 contact the sidewalls of the oversized holes 64. Although somewhat limited, the upward movement of the knife support and second cutting edge 56 provided by the release means 78 of this embodiment of the present invention protects the baling apparatus 10 from structural damage upon the application of excessive forces to the second cutting edge. Following the separation of the separation means, the compaction operations can be temporarily suspended and the cause of the excessive forces can be located and removed. Thereafter, the separation means can be repaired or replaced and the knife support and second cutting edge can be repositioned prior to resuming compacting operations.

As illustrated, the separation means can include first and second release members 88 extending through first and second apertures, respectively, defined by the interconnecting member 80, which are aligned with the first and second reinforcing frames, respectively. The first and second release members, such as breakaway bolts, threadably engage both the interconnecting member and the first and second reinforcing frames 42 and 48, respectively. The first and second release members are adapted to break or fracture upon the application of forces to the second cutting edge 56 which exceed the predetermined maximum force. Alternatively, the separation means can include other means, such as relatively low quality welds, which connect the interconnecting member and the first and second reinforcing frames and are adapted to break upon the application of forces to the cutting edge which exceed the predetermined maximum force without departing from the spirit and scope of the present invention.

As illustrated in FIGS. 3–5, the release means 78 preferably includes a pair of interconnecting members 80 and associated adjustment members 66 and separation means. The pair of interconnecting members are preferably spaced apart and, more preferably, are positioned between laterally opposed portions of the first and second reinforcing frames 42 and 48, respectively, to provide controlled positioning of the knife support 58 and, in particular, controlled positioning of the second cutting edge 56.

Therefore, according to one embodiment of the present invention, the baling apparatus 10 includes a first reinforcing frame 42 disposed generally circumferentially about at least a portion of the housing 14 to structurally reinforce the housing during the compaction of a bale. Accordingly, the rigidity of the baling apparatus and, in particular, the housing is increased such that the baling apparatus can repeatedly withstand the relatively high forces generated during the compaction of a bale. In addition, the first reinforcing frame facilitates the fabrication of a baling apparatus by providing a jig or assembly device to support the floor panel 34 and first and second opposed side panels 35 in a predetermined positional relationship during the assembly of the housing. In another embodiment, the baling apparatus includes an adjustable knife assembly 54 for severing loose materials within the charging passage 16 from other loose materials. The knife assembly includes a second cutting edge 56 which can be controllably positioned and laterally guided such that the first and second cutting edges are controllably spaced and aligned, thereby providing safe and efficient severing of the loose materials extending beyond the charging passage during compaction operations.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. An apparatus for baling loose materials, the apparatus comprising:

a housing defining a charging passage and a compaction chamber in communication with the charging passage, wherein said housing comprises a floor panel and first and second opposed side panels, and wherein said housing further comprises an upper panel defining an opening therein which is in communication with the charging passage and which is adapted to receive the loose materials for collection within the charging passage;

a compacting ram assembly disposed at least partially within the charging passage and adapted for movement therein such that the loose materials which are collected within the charging passage are urged into the compaction chamber and are compacted into a bale therein;

a door mounted to said housing and adapted for movement relative to said housing to thereby provide an opening to the compaction chamber through which a compacted bale can be ejected; and a first reinforcing frame disposed generally circumferentially about at least a portion of said housing and having an aperture defined therethrough, wherein at least the first and second opposed side panels of said housing extend through the aperture defined by said first reinforcing frame such that said first reinforcing frame structurally reinforces said housing during the compaction of a bale, and wherein the aperture defined by said first reinforcing frame includes an enlarged portion through which said door moves in order to provide an opening to the compaction chamber.

2. An apparatus according to claim 1 wherein the charging passage extends longitudinally through the housing, wherein said compacting ram assembly is adapted to move longitudinally within the charging passage such that the loose materials are urged longitudinally downstream into the compaction chamber, and wherein said first reinforcing frame is disposed circumferentially about a portion of said housing longitudinally downstream of the opening defined by the upper panel of said housing.

3. An apparatus according to claim 2 wherein the charging passage includes an exit end adjacent the compaction chamber, and wherein said first reinforcing frame is disposed circumferentially about a portion of said housing which defines the exit end of the charging passage.

4. An apparatus according to claim 1 wherein said compacting ram assembly comprises a compacting ram platen having a first cutting edge disposed along an upper edge thereof, and wherein the baling apparatus further comprises a knife assembly, attached to said first reinforcing frame, for cooperating with said first cutting edge to sever portions of the loose materials within the charging passage from other portions of the loose materials.

5. An apparatus according to claim 4 wherein said knife assembly comprises a second cutting edge adapted for adjustable movement relative to said first reinforcing frame such that the relative spacing between said first and second cutting edges is thereby controlled.

6. An apparatus according to claim 5 wherein said first reinforcing frame comprises an upper frame portion and first and second opposed side frame portions extending downwardly from respective ends of the upper frame portion, and wherein said second cutting edge is attached to the upper frame portion of said first reinforcing frame.

7. An apparatus according to claim 1 further comprising a second reinforcing frame spaced apart from said first reinforcing frame and disposed generally circumferentially about a portion of said housing defined by the floor panel and the first and second opposed side panels, wherein said second reinforcing frame also defines an aperture through which the floor panel and the first and second opposed side panels of said housing extend such that said second reinforcing frame provides additional structural reinforcement to said housing during compaction of a bale.

8. An apparatus for baling loose materials, the apparatus comprising:

a housing defining a charging passage and a compaction chamber in communication with the charging passage, wherein said housing comprises a floor panel and first and second opposed side panels, and wherein said housing further comprises an upper panel defining an opening therein which is in communication with the charging passage and which is adapted to receive the loose materials for collection within the charging passage;

a compacting ram assembly disposed at least partially within the charging passage and adapted for movement therein such that the loose materials which are collected within the charging passage are urged into the compaction chamber and are compacted into a bale therein, wherein said compacting ram assembly comprises a compacting ram platen having a first cutting edge disposed along an upper edge thereof;

a first reinforcing frame disposed generally circumferentially about at least a portion of said housing and having an aperture defined therethrough, wherein at least the first and second opposed side panels of said housing extend through the aperture defined by said first reinforcing frame such that said first reinforcing frame structurally reinforces said housing during the compaction of a bale; and a knife assembly, attached to said first reinforcing frame, for cooperating with said first cutting edge to sever portions of the loose materials within the charging passage from other portions of the loose materials, wherein said knife assembly comprises a second cutting edge adapted for adjustable movement relative to said first reinforcing frame such that the relative spacing between said first and second cutting edges is thereby controlled, and wherein said knife assembly further comprises a lateral guide, attached to said first reinforcing frame, for controlling the lateral position of said second cutting edge such that said first and second cutting edges are aligned.

9. An apparatus for bating loose materials, the apparatus comprising:

a housing defining a charging massage and a compaction chamber in communication with the charging passage, wherein, said housing comprises a floor panel and first and second opposed side panels, and wherein said housing further comprises an upper panel defining an opening therein which is in communication with the charging passage and which is adapted to receive the loose materials for collection within the charging passage;

a compacting ram assembly disposed at least partially within the charging passage and adapted for movement therein such that the loose materials which are collected within the charging passage are urged into the compaction chamber and are compacted into a bale therein, wherein said compacting ram assembly comprises a compacting ram platen having a first cutting edge disposed along an upper edge thereof;

a first reinforcing frame disposed generally circumferentially about at least a portion of said housing and having an aperture defined therethrough, wherein at least the first and second opposed side panels of said housing extend through the aperture defined by said first reinforcing frame such that said first reinforcing frame structurally reinforces said housing during the compaction of a bale; and a knife assembly, attached to said first reinforcing frame for cooperating with said first cutting edge to sever portions of the loose materials within the charging passage from other portions of the loose materials, wherein said knife assembly comprises a second cutting edge adapted for adjustable movement relative to said first reinforcing frame such that the relative spacing between said first and second cutting edges is thereby controlled, wherein said knife assembly further comprises a knife support to which said second cutting edge is attached, and wherein said knife support is adjustably attached to said first reinforcing frame such that the relative spacing between said first and second cutting edges can be controllably varied.

10. An apparatus according to claim 9 wherein said knife assembly further comprises an adjustment member for adjusting the position of said knife support relative to said first reinforcing frame to thereby control the relative spacing between said first and second cutting edges.

11. An apparatus for baling loose materials, the apparatus comprising:

a housing defining a charging passage and a compaction chamber in communication with the charging passage, wherein said housing comprises a floor panel and first and second opposed side panels, and wherein said housing further comprises an upper panel defining an opening therein which is in communication with the charging passage and which is adapted to receive the loose materials for collection within the charging passage;

a compacting ram assembly disposed at least partially within the charging passage, said compacting ram assembly comprising a compacting ram platen having a first cutting edge disposed along an upper edge thereof, the compacting ram platen being adapted for movement within the charging passage such that the loose materials which are collected therein are urged into the compaction chamber and are compacted into a bale therein; and a knife assembly for cooperating with said first cutting edge to sever portions of the loose materials within the charging passage from other portions of the loose materials, wherein said knife assembly comprises:

a frame member attached to said housing at a location proximate the opening defined in the upper panel;

a second cutting edge attached to said frame member and adapted for adjustable movement relative to said frame member such that the relative spacing between said first and second cutting edges is controlled; and a lateral guide, attached to said frame member, for controlling the lateral position of said second cutting edge such that said first and second cutting edges are aligned.

12. An apparatus according to claim 11 wherein said knife assembly further comprises a knife support to which said second cutting edge is attached, and wherein said knife support is adjustably attached to said frame member such that the relative spacing between said first and second cutting edges can be controllably varied.

13. An apparatus according to claim 12 wherein said knife assembly further comprises an adjustment member for adjusting the position of said knife support relative to said frame member to thereby control the relative spacing between said first and second cutting edges.

14. An apparatus according to claim 12 wherein said knife support includes laterally opposed edge portions, and wherein said lateral guide comprises first and second lateral guide members positioned adjacent a respective edge portion of said knife support and adapted to maintain proper lateral position of said second cutting edge as said knife support is adjusted relative to said frame member.

15. An apparatus according to claim 14 wherein each of said first and second guide members comprise a prismatic guide having a predetermined exterior shape, and wherein the laterally opposed edge portions of said knife support have a predetermined shape which corresponds to the predetermined exterior shape of said adjacent prismatic guide.

16. An apparatus according to claim 15 wherein each of said first and second guide members comprises lateral adjustment means for laterally adjusting the respective prismatic guide relative to said frame member such that the lateral position of said knife support is further controlled.

17. An apparatus according to claim 11 wherein said second cutting edge comprises a serrated cutting edge.

18. An apparatus according to claim 11 wherein said frame member comprises a first reinforcing frame disposed generally circumferentially about at least a portion of said housing and having an aperture defined therethrough, wherein at least the first and second opposed side panels of said housing extend through the aperture defined by said first reinforcing frame such that said first reinforcing frame structurally reinforces said housing during the compaction of a bale.

19. An apparatus according to claim 18 wherein said first reinforcing frame comprises an upper frame portion and first and second opposed side frame portions extending downwardly from respective ends of the upper frame portion, and wherein said second cutting edge is attached to the upper frame portion of said first reinforcing frame.

20. An apparatus according to claim 18 wherein said knife assembly further comprises a second reinforcing frame spaced apart from said first reinforcing frame and disposed generally circumferentially about a portion of said housing defined by the floor panel and the first and second opposed side panels, and wherein said second reinforcing frame also defines an aperture through which the floor panel and the first and second opposed side panels of said housing extend such that said second reinforcing frame provides additional structural reinforcement to said housing during the compaction of a bale.

21. An apparatus according to claim 20 wherein said knife assembly further comprises release means for controllably releasing said second cutting edge upon the application of forces to said second cutting edge which exceed a predetermined maximum force to thereby prevent damage to the baling apparatus.

22. An apparatus according to claim 21 wherein said release means comprises:

an interconnecting member extending between said first and second reinforcing frames and defining a center aperture between said first and second reinforcing frames;

an adjustment member for adjusting the position of said second cutting edge relative to said first reinforcing frame, wherein said adjustment member extends through the center aperture defined by said interconnecting member and is positionally engaged therewith; and separation means connectably engaging said interconnecting member and said first and second reinforcing frames, wherein said separation means is adapted to disengage said interconnecting member from said first and second reinforcing frames upon the application of forces to said second cutting edge which exceed the predetermined maximum force.

* * * * *